United States Patent [19]

Dardaine

[11] 4,270,335

[45] Jun. 2, 1981

[54] METHOD OF AUTOMATIC PACKAGING OF MATERIALS IN CONTAINERS AND MACHINE FOR CARRYING OUT THE SAID METHOD

[75] Inventor: Edgar Dardaine, Sorel-Moussel, France

[73] Assignee: E. P. Remy et Cie, Dreux, France

[21] Appl. No.: 50,793

[22] Filed: Jun. 21, 1979

[30] Foreign Application Priority Data

Jun. 23, 1978 [FR] France ..... 78 18871

[51] Int. Cl.[3] ..... B65B 61/26

[52] U.S. Cl. ..... 53/411; 53/131

[58] Field of Search ..... 53/131, 282, 411

[56] References Cited

U.S. PATENT DOCUMENTS 3,176,442 4/1965 Ganz ..... 53/48

3,643,796 2/1972 Arneson ..... 206/158

4,151,698 5/1979 Muller et al. ..... 53/131

*Primary Examiner*—Horace M. Culver

*Attorney, Agent, or Firm*—Kenyon & Kenyon

[57] ABSTRACT

The present invention relates to a machine for automatic packaging of food products in cup-shaped containers grouped in a row in a cardboard support. This machine comprises essentially a device for marking the support and its associated containers, as well as a device for bending down the sides of the support to a position substantially parallel with the axis of the containers. This latter device comprises essentially a vertically movable unit including two horizontal bars vertically movable with respect to the unit and capable of passing in the intervals between two successive plates supporting the containers so as to turn down the edges of the support.

15 Claims, 5 Drawing Figures

METHOD OF AUTOMATIC PACKAGING OF MATERIALS IN CONTAINERS AND MACHINE FOR CARRYING OUT THE SAID METHOD

The present invention relates essentially to a method of automatic packaging of materials in containers, such as cup or like shaped packages, previously inserted into the apertures of a support forming a retaining plate for the containers.

Such a method advantageously provides a package of containers grouped preferably along a line on a cardboard retaining plate.

The invention is also directed to a machine for carrying out the said method and performing in a simple, efficient and automatic manner all the operations leading to the above product.

There are already known machines performing a sequence of packaging operations using cup or like shaped packages intended to be filled with a food product and which are grouped on a retaining plate to thus be offered for sale. More precisely, those machines comprise a certain number of devices arranged successively above a set of chains driving the packaging cups, namely, in particular, a device for conveying the supports or plates for retaining the cups, a device for supplying the containers into the said supports, a device for filling the containers, as well as a device for supplying and welding closures on top the containers.

However, such machines are not provided with the means necessary for obtaining products packaged in cups ready for sale and grouped along a line by being maintained in a cardboard support whose edges, possibly provided with a marking or an imprint, are merely bent or turned down.

The purpose of the present invention is to remedy the lack of such means by providing a method and a device for automatic packaging of materials in containers, which are particularly reliable and allow the above product to be obtained with all the required qualities.

To this end, the invention is directed to a method of automatic packaging of materials in containers, such as cup or like shaped containers, of the type including inserting the said containers, preferably along a line, into the apertures of a support forming a retaining plate for the containers, in filling the containers with any desired product, such as for example a food product, and in closing them individually before withdrawing them from the machine, characterized in that before withdrawing the said containers from the machine, the sides of the support retaining the containers are bent or turned down so as to maintain the said sides directed in substantially parallel relationship to the axis of the containers.

According to another characterizing feature of the method of the invention, there is performed, before bending down the sides of the support, a marking on at least one of the said sides and possibly a simultaneous marking on the containers proper.

It should be noted that, during the marking operation, the underside of the sides of the said support is supported.

According to still another characterizing feature of the invention, during the bending of the sides of the support, the said support with its associated containers has its underside supported and its upside maintained, so as to allow the simultaneous bending of two sides of the support.

It should also be added that in performing the bending of the said sides of the support, one of the sides of the adjacent supports is bent down simultaneously as a result of the fact that the sides of the successive supports on the machine overlap one another.

According to still another characterizing feature of the method of the invention, the successive operations of filling, closing of the containers, marking and bending of the support are effected by accompanying the containers over a certain distance to thereafter be effected on the following container after the backward and simultaneous return of the means performing the said four functions.

The invention is also directed to a machine for carrying out the above method, of the type including a set of chains driving plates provided with apertures and mounted transversely to the chains, as well as a certain number of means arranged successively above the said chains, namely, in particular, a device for conveying the said supports onto the said plates, a device for supplying the containers into the supports on the plates, a device for filling the containers, as well as a device for supplying and welding closures on top the containers, characterized in that after the welding device there is provided a device for marking the supports and their associated containers, as well as a device for bending down the sides of the supports.

According to another characterizing feature of the machine, the bending device comprises a vertically movable unit bearing on the upside of the supports and comprising two horizontal bars movable vertically with respect to the said unit and adapted to pass downward in the gap between each two successive plates in order to perform the bending.

It will also be noted that, according to the invention, a group of elements arranged vertically and actuated by a cam is provided under the said marking and bending devices to support the said transverse plates as well as the supports on those plates.

The said group of elements, according to a preferred form of embodiment, is constituted by substantially parallel plates, the upper edges of which comprise projecting portions forming indents.

According to another characterizing feature of the machine, the marking device is constituted by marking stamps associated with hinged inking means which, during the marking, are retractable by means of a system of links.

According to still another characterizing feature of the invention, the transverse plates secured to the chains are provided with pins, dowels or the like for centering the cardboard supports for the cups, the said supports being provided to this end with corresponding holes.

It will also be noted that, according to the invention, the devices for filling the containers, supplying and welding the closures on the containers, as well as the marking and bending devices are jointly movable in translation by means of bars or the like slidingly mounted in guiding bearings secured to the machine frame.

Other characterizing features and advantages of the invention will appear more clearly from the following description made with reference to the appended drawings given solely by way of example and wherein:

FIG. 1*a* is a diagrammatic elevational view of the machine according to the invention, with parts of its left portion broken away;

FIG. 1*b* is the continuation of FIG. 1*a*, representing the right half of the machine;

Figure 1A:
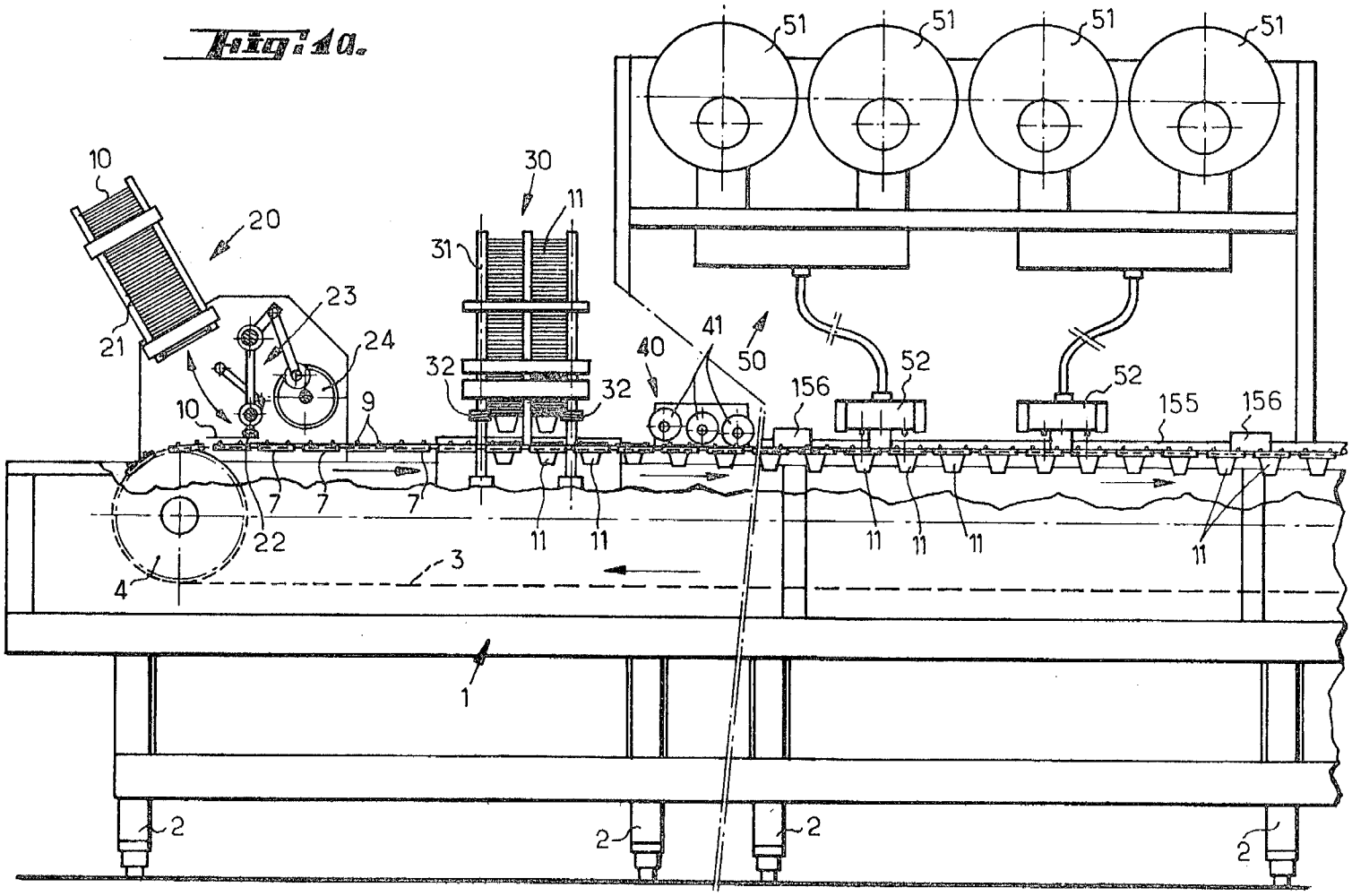
Figure 1B:
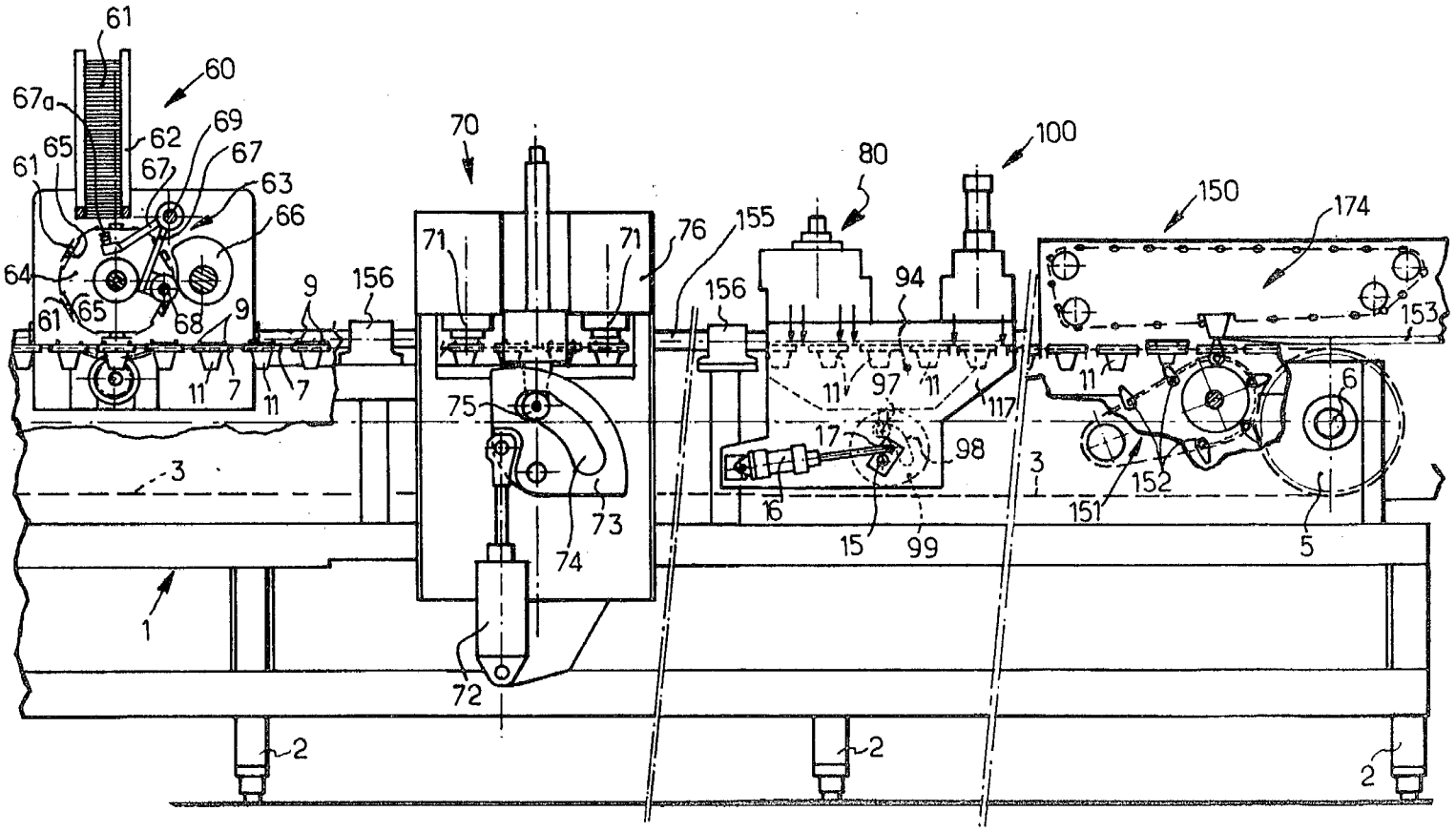

According to one example of embodiment and referring more particularly to FIGS. 1*a* and 1*b*, a machine for automatic packaging of materials according to the invention comprises essentially a frame 1 resting upon the ground through the medium of feet 2 and supporting two conveyor chains 3 passing around toothed wheels 4 and 5, the toothed wheel 5 being keyed to the output shaft 6 of a motor (not shown).

Figure 4:
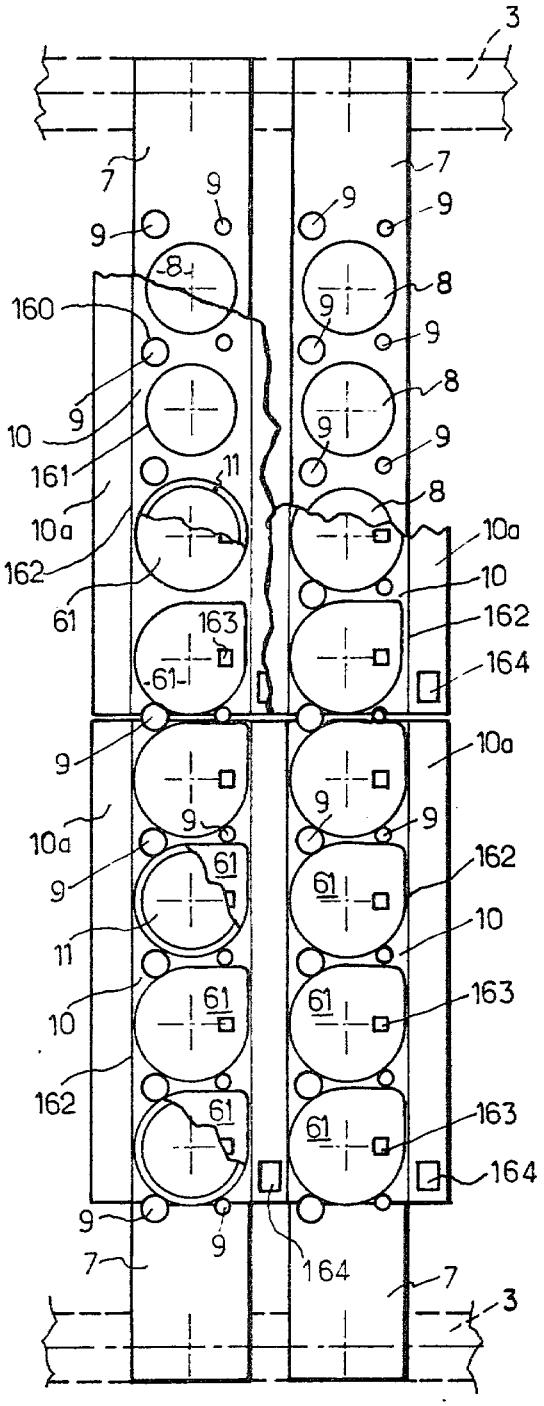
FIG. 4 is a top view of the transverse plates carrying the supports and their associated cups, the said plates having just passed through the marking station and being conveyed to the support side bending station.

Transversely to the chains 3 are mounted rectangular plates or the like 7 spaced along the chains, as seen better in FIG. 4. The plates 7 are provided with apertures 8 and pins or dowels 9 for centering cardboard retainer blanks such as supports 10 on the said rectangular plates, which supports are provided with apertures corresponding to the apertures 8 of the plates 7 in which are retained the cup-shaped packages 11 intended to receive any desired product such as for example a food product of the yogurt type.

A certain number of devices are arranged above the chains 3 and will be enumerated successively by referring to FIGS. 1*a* and 1*b* before describing their structure and operation in more detail.

Those devices follow one another in the following sequence:

- a device 20 for conveying the supports 10 onto the transverse plates 7;
- a device 30 for supplying the containers or cups 11 into the supports 10 resting on the plates 7;
- a device 40 for snap fixing of the cups 11 in the supports 10;
- a device 50 for filling the cups 11;
- a device 60 for supplying closures 61 onto the top of the cups 11;
- a device 70 for heat sealing of the closures 61 on the cups 11;
- a device 80 for marking the supports 10 and their associated cups 11;
- a device 100 for bending or turning down the sides or edges of the supports 10; and
- a device 150 for withdrawing and discharging the groups of cups retained along a line in the supports 10.

There will now be described in more detail each of the aforesaid devices as well as their operation, in the same sequence as previously.

The device 20 for conveying the supports 10 comprises essentially a feeding hopper 21 from which the supports 10 are extracted by small suction-grip members 22 capable of substantially circular displacement owing to a system of hinged links 23 and actuated by an eccentric, as shown in 24.

Thus, the suction-grip members 22 suck the supports 10 from the hopper 21 and lay them down onto a transverse plate 7, as seen clearly in FIG. 1*a*, the said supports then being conveyed towards the device 30 for the supply of cups 11.

As seen clearly in FIG. 1*a*, the device 30 comprises essentially a hopper 31 from which the stacked cups 11 move down in rows (two rows in the example illustrated) into the apertures 8 of the plates 7 by means of rotating guides 32 provided with a helical slot.

At this stage, the cups 11 are not completely driven into the apertures provided in the supports 10 and, for this reason, are conveyed to the snap fixing station 40.

The device 40 comprises essentially a set of pressing rollers 41 acted upon by springs (not shown) downwardly so as to ensure a reliable snap fixing of the cups 11 in the supports, i.e. a reliable bearing of the cup flanges against the surface of said supports.

The cups 11 are thereafter filled with the desired product, such as for example a food product, by means of the device 50, about which it will only be mentioned that it comprises any suitable number of tanks 51 for the said product, as well as dispensing heads 52, as seen clearly in FIG. 1*a*.

The cups thus filled reach the station 60 seen in FIG. 1*b* and which comprises essentially a hopper 62 containing the closures 61, which are transferred onto the tops of the cups 11 by means of a system 63 of suction-grip members. This system comprises essentially a rotary cylindrical element 64 carrying on its periphery small suction-grip members 65. A cam 66 actuates through the medium of rollers 68 connected to rods or the like 67 hinged at 69 and carrying small suction-grip members 67*a*.

It is understood that, as a result of the rotation of the cam 66, the suction-grip members 67*a* extract the closures 61 from the hopper 62 and place them on the suction-grip members 65 by which they are thereafter handled to be transferred onto the top of the cups 11. The closures 61 correctly positioned on top the cups are thereafter secured to the latter by means of the heat-seal closing device 70.

This device, generally known per se, comprises essentially heat sealing heads 71 movable vertically by means of a fluid-operated actuator 72 which actuates a member 73 provided with an opening 74 forming a cam path for a roller or the like 75 attached to the heads 71. It will be noted here that, in FIG. 1*b*, the frame 76 carrying the heat sealing heads 71 is shown in the upper position for the sake of clarity.

The cups 11 thus filled and closed then reach the marking station 80 which will now be described with particular reference to FIG. 2.

The marking device 80 comprises essentially a stationary frame 81 supporting a pinion 82 through the medium of bearings 83 secured to the said frame, which pinion is keyed to a shaft 84 actuated by a crank 85 connected to the rod 86 of a fluid-operated actuator (not shown). More precisely, reference numeral 86 shows the end of the rod of this actuator. The pinion 82 meshes with a rack 87 jointly displaceable with a movable assembly 88 carrying rows of marking stamps 89. With the stamps 89 are associated inking pads 90 secured to cross-members 91 hingedly mounted at 92 on the stationary frame 83 and connected to the movable assembly 88 through the medium of links 93.

As seen clearly in FIG. 2, the vertical downward motion of the movable assembly 88 as a result of the rotation of the pinion 82 will provide a marking on the closures 61 and on the sides of the supports 10 as will be described later, and the inking pads 90 will retract on the downward motion of the marking stamps 89. On the contrary, when the movable assembly 88 rises, the inking pads 90 will automatically move to a position under and in contact with the marking stamps 89.

According to the example of embodiment illustrated, the movable assembly 88 carries two double rows of marking stamps. One of the rows 89*a* is intended to provide an imprint on the closures of the cups in the line, whereas the other row 89*b* provides a marking on one of the sides of the supports 10.

During the marking operation, the sides of the supports 10, which overlap between two successive transverse plates 7, are supported by a set of plates 94 (see also FIG. 3) mounted on a vertically movable cross-member 95 guided by cylindrical rods 96 secured to the frame. The vertical plates 94 are driven vertically by a roller 97 rolling in an opening forming a cam path 98 in a disc 99 eccentrically mounted on a shaft 15 driven by fluid-operated actuators 16, and through the medium of a crank 17, as seen clearly in FIG. 1*b*.

Figure 2:
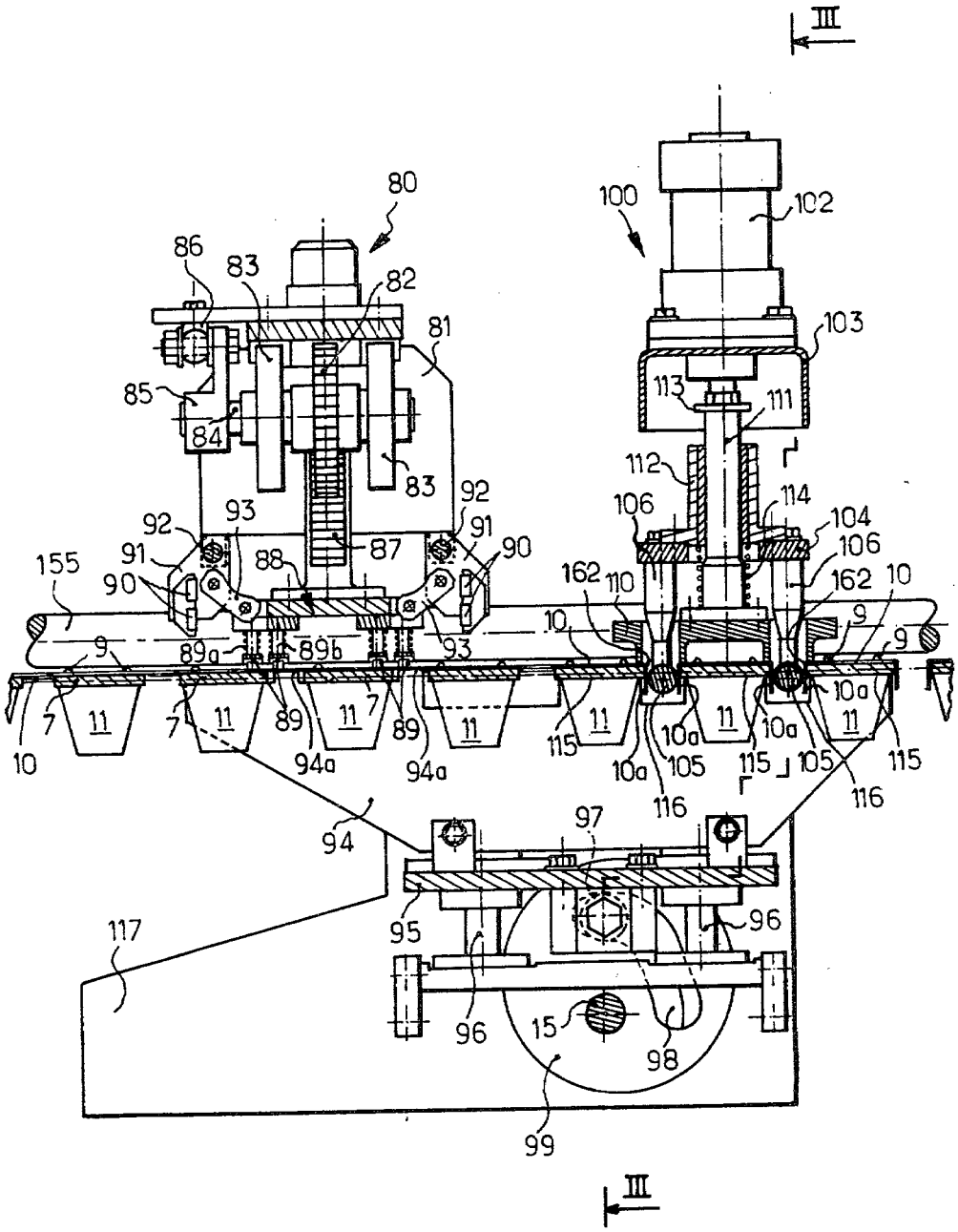
FIG. 2 is an enlarged view, with parts broken away, of the marking and bending devices shown in FIG. 1*b*.

Reverting to FIG. 2, it is seen that the upper edge of each of the plates 94 is provided with projecting portions 94*a* forming indents and moving into abutment with the underside of the superposed sides of the supports 10 so as to support them during the marking. The projections 94*a* are of course intended to be intercalated between two successive transverse plates 7, as seen clearly in FIG. 2.

The cups 11 and their supports 10 thus marked then reach the bending device 100.

Figure 3:
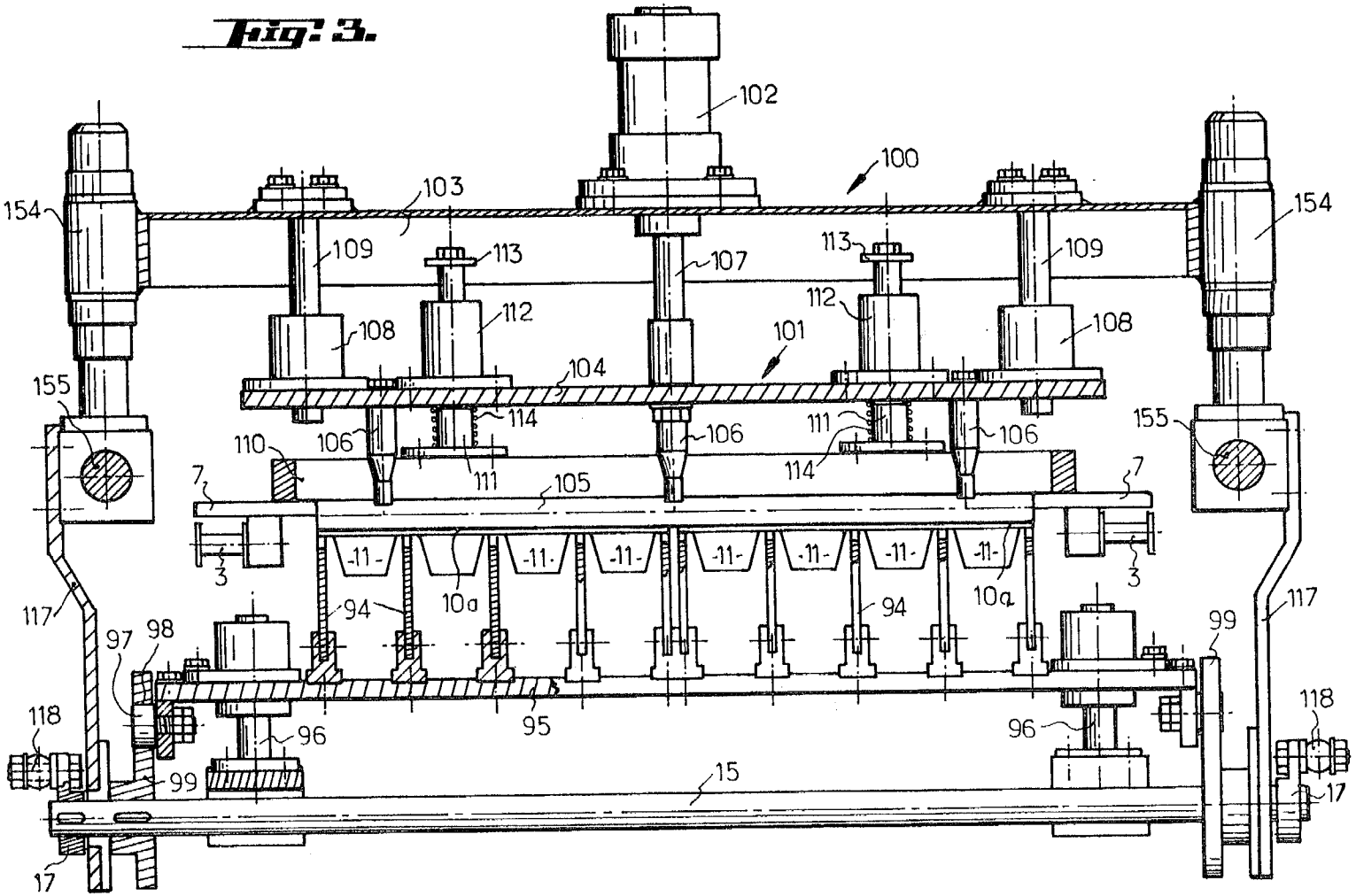
FIG. 3 is a sectional view of the folding device substantially along the line III—III of FIG. 2.

As seen in FIG. 2 and still more clearly in FIG. 3, this device comprises essentially a movable unit 101 displaceable vertically by means of a fluid-operated actuator 102 secured to a fixed U-shaped portion 103 serving as a supporting frame for the assembly 100. The movable unit 101 is constituted by a cross-member 104 carrying two horizontal cylindrical bars 105 through the medium of supports 106. The cross-member 104 is attached to the rod 107 of the actuator 102 and moves through the medium of sleeve-and-ball members 108 along bars 109 secured to the U-shaped portion 103 of the frame. A strip 110 is associated with the cross-member 104 through the medium of members 111 sliding in sleeves 112 secured to the said cross-member. The strip 110 is thus relatively displaceable with respect to the cross-member 104. At 113 are shown butt rings retaining the members 111 and therefore the strip 110 under the cross-member 104. The numeral 114 denotes springs permanently acting upon the strip 110 in the direction from the cross-member 104. The operation of the device 100 is as follows.

The rod 107 of the actuator 102 moves the cross-member 104 and therefore the strip 110 downward until the latter bears upon the portion of the supports 10 resting on the plates 7, thus maintaining the said supports. At that moment the strip 110 is stopped in its downward travel, but the travel of the cross-member 104 and therefore the horizontal bars 105 continues between two successive plates 7, so that the sides 10*a* of the supports 10 are pushed downward and compelled to bend or turn down until they assume a position substantially parallel with the axis of the cups 11, as seen clearly in FIG. 2. To improve such bending of the edges 10*a* of the supports 10, cutting lines may advantageously be provided on the cardboard supports 10 as denoted at 168 in FIGS. 2 and 4.

It should be noted here that the support or backing plates 94 described previously also fulfil a function in respect of the bending device 100 just described. Indeed, the plates 94 support by their upper edge the transverse plates 7 as shown at 115 in FIG. 2 and are provided with notches 116 allowing the passage of the bars 105 in the intervals between two plates 7. Thus, the turning down of the edges 10*a* can be performed efficiently.

At 117 in FIGS. 1*b*, 2 and 3 are shown side plates pertaining to the marking and bending devices 80 and 100 and supporting the shaft 15 as well as two fluid-operated actuators such as 16 ensuring the vertical mobility of the group of support plates 94 as described previously. The fixing of the rods of the actuators 16 appears at 118 in FIG. 3. It should be noted here that the set of support plates 94 is in a way common to the marking device 80 and the bending device 100.

After the bending, the rows of cups retained in their cardboard supports are withdrawn from the machine by the device 150 which, as seen clearly in FIG. 1*b*, comprises essentially a mechanism 151 for driving fingers or the like 152 adapted to extract the lines of cups from the apertures 8 of the plates 7, as well as a conveyor 174 receiving the rows of cups after their extraction from the plates 7 to convey the same on tracks or the like 153. At this stage, the rows of cups 11 can be received by another conveyor (not shown) for encasing or boxing purposes.

At 154 in FIG. 3 are shown columns, uprights or the like secured to the U-shaped member 103 of the device 100, which columns are attached to the side plates 117 and also to two bars 155 parallel with the chains 3 and seen in FIGS. 1*a*, 1*b*, 2 and 3.

According to the invention, the bars 155 are associated with the filling device 50, the devices 60 and 70 for the supply and heat sealing of the closures 61 on the cups 11, as also with the marking device 80 and the device 100 for bending down the sides of the supports 10, and in the latter case, as just described above. The bars 155 are slidingly mounted in bearings 156 secured to the machine frame 1.

Thus, according to the example of embodiment illustrated, the successive operations of filling, supplying and heat sealing of the closures, marking the cups and the sides of the supports and bending the sides of the supports can be performed, according to the invention, by accompanying the cups 11 over a certain distance, for example two rows of cups, to thereafter be performed on the following rows of cups, after the simultaneous return backward of the five devices ensuring the five aforementioned functions, respectively. Consequently, these operations can be performed while the cups 11 are being advanced continuously on the chains 3, thus accounting for the high rate of production which can be obtained. The kinematic chain as well as the various synchronizations which of course are provided in the machine have not been explained in detail, for they do not fall within the scope of the present invention.

As shown diagrammatically in FIG. 4, the machine according to the invention allows the desired product to be packaged for example in four cups retained by a cardboard support provided initially with holes 160 according to a distribution corresponding to the centering pins 9 on the transverse plates 7. The cardboard support 10 is of course provided, as mentioned above, with apertures 161 corresponding of course to the apertures 8 of the plates 7. At 162 is shown the cutting line of the substantially rectangular cardboard supports 10, in such a manner, as pointed out previously, as to facilitate the bending down of the lateral edges 10*a* which, as it will be noted, overlap between two successive plates 7. Lastly, at 163 is diagrammatically shown a marking or imprint made on the closures 161 by the device 80, and at 164 is denoted a marking made on one of the sides 10*a* of each cardboard support 10. This marking may consist of the limit date of consumption of the product contained in the cups or of any other indication, as is also the case with the imprint provided on the closures 61.

According to the example illustrated, each transverse plate 7 between the chains 3 can receive two cardboard supports such as 10 of a width slightly greater than that of the plates 7, but it is quite obvious that by means of the machine considered there can be obtained cups grouped in rows with a number of cups other than 4, without departing from the scope of the invention. Also, the width of the plates 7 and their length can be selected according to needs, as also the locations of the apertures 8 provided in the said plates.

Therefore, the invention is by no means limited to the form of embodiment described and illustrated which has been given by way of example only. On the contrary, the invention comprises all technical means equivalent to those described as well as their combinations should the latter be carried out according to its gist and used within the scope of the following claims.

What is claimed is:

1. A method of automatically packaging materials into containers, the method including conveying a plurality of flat horizontally disposed retainer blanks in sequence along a predetermined path, each retainer blank having a plurality of container-supporting apertures therein; inserting containers into the apertures of each retainer blank; filling the containers with a product material; individually closing each container; and bending down two opposed marginal portions of each retainer blank to form substantially vertical sides, wherein the improvement comprises:

marking at least one of said two marginal portions before said bending step.

2. The method of claim 1, further comprising marking each container in said retainer blanks simultaneously with the marking of the marginal portion of the blank.

3. The method of claim 1, wherein said marking step comprises marking at least part of the upper surface of the at least one marginal portion of said retainer blank, and simultaneously supporting at least the portion of the under surface of the retainer blank directly beneath the part of said upper surface being marked to prevent downward deflection of the at least one marginal portion of the retainer blank during said marking step.

4. The method of claim 1, wherein said bending step comprises supporting at least the portions of the under surface of the retainer blank adjacent to and inboard of each of said opposed marginal portions; resiliently pressing against the corresponding portions of the upper surface of the retainer blank adjacent to said marginal portions to maintain said portions of the blank; and simultaneously bending down said two marginal portions.

5. A method according to claim 1, further comprising positioning said retainer blanks so that said two opposed marginal portions of each blank extend transversely with respect to said predetermined path and so that the leading marginal portion of each blank overlaps the trailing marginal portion of the preceding blank, and said bending step comprises simultaneously bending the leading and trailing marginal portions of adjacent retainer blanks.

6. A method according to claim 1, wherein said conveying step comprises moving said retainer blanks along said predetermined path during said filling, closing, marking, and bending operations, each of said operations being performed by accompanying each retainer blank along said path for the duration of the respective operation.

7. Apparatus for automatically filling and packaging containers in a flat retainer blank having apertures for receiving said containers and two opposed marginal portions, said apparatus including a conveyor having a plurality of rectangular plates arranged in spaced succession along a predetermined path, each plate having a plurality of apertures corresponding to the apertures in a retainer blank, means for moving the plates in succession along said predetermined path, means positioned at a first station along said path for placing a retainer blank on each plate such that the apertures of the blank register with the apertures in the plate, means positioned at a second station above said path for placing a container into each aperture of each retainer blank, means positioned at the third station above said path for filling the containers with a product material, and means positioned at a fourth station above said path for supplying and sealing closures for the containers, wherein the improvement comprises:

means positioned at a fifth station above said path for marking each retainer blank and means positioned at a sixth station above said path for folding down the two opposed marginal portions of each retainer blank.

8. Apparatus according to claim 7, wherein the two opposed marginal portions of each retainer blank overhang opposite edges of the corresponding plate, and said means positioned at the sixth station comprises a vertically movable unit arranged to bear resiliently against the upper surface of each retainer blank over the corresponding plate; two horizontal bars vertically movable with respect to the unit and positioned over the two opposed marginal portions of each retainer blank; and means for moving said horizontal bars downward past said opposite edges of each plate for folding down said opposed marginal portions of the corresponding retainer blank.

9. Apparatus according to claim 8, wherein said opposite edges of each plate and the opposed marginal portions of each retainer blank extend transversely to the predetermined path of said conveyor, and said two horizontal bars are capable of passing downward in the spaces between successive plates.

10. Apparatus according to claim 9 further comprising a plurality of vertically movable elements positioned underneath the conveyor at said sixth station, and means for moving said elements upward into supporting contact with said plates in synchronism with the downward movement of said horizontal bars past the opposite edges of the plate.

11. Apparatus according to claim 10, wherein said plurality of vertically movable elements comprises a plurality of spaced vertical plates extending parallel to and underneath said predetermined path, each plate having a horizontal upper edge provided with indents for allowing downward passage of said horizontal bars.

12. Apparatus according to claim 7, wherein said marking means comprises at least one marking stamp and inking means normally in contact therewith, said inking means being hingedly mounted; means for moving said marking stamps vertically downward into contact with the upper surface of each retainer blank during passage of the latter through said fifth station; and means for retracting said inking means in synchronism with the actuation of said marking stamp moving means.

13. Apparatus according to claim 12, wherein said marking stamp is positioned to place a mark on one of said two marginal portions of each retainer blank, and the apparatus further comprises a vertically movable element positioned underneath the conveyor at said fifth station, and means for moving said element upward into support contact with the under surface of said one marginal portion directly beneath said marking location in synchronism with the actuation of said marking stamp moving means.

14. Apparatus according to claim 7, wherein each retainer blank has at least one locating hole, and each conveyor plate has a corresponding protrusion for registering the apertures in said blank with the apertures in said plate.

15. Apparatus according to claim 7, further comprising means for slidably mounting each of said operating means positioned at the first through the sixth stations for translation over a limited distance parallel to the predetermined path of the conveyor, whereby the operations at each station can be performed periodically while the conveyor is continuously moving.

* * * * *